United States Patent [19]

Willis

[11] Patent Number: 4,784,758

[45] **Date of Patent: * Nov. 15, 1988**

[54] PROCESS FOR REMOVING MAGNETIC PARTICLES FROM A SUSPENSION OF SOLIDS IN A LIQUID

[75] Inventor: Mitchell J. Willis, Macon, Ga.

[73] Assignee: Engelhard Corporation, Menlo Park, N.J.

[ * ] Notice: The portion of the term of this patent subsequent to Nov. 1, 2005 has been disclaimed.

[21] Appl. No.: 900,666

[22] Filed: Aug. 27, 1986

[51] Int. Cl.[4] ..... B03C 1/02

[52] U.S. Cl. ..... 209/214; 134/95; 134/98; 134/99; 209/223.1; 209/228; 210/695; 210/698

[58] Field of Search ..... 209/3, 214, 215, 5, 209/223.1, 228, 232, 225; 210/222, 223, 695, 793, 794, 798; 134/95, 98, 99

[56] References Cited

U.S. PATENT DOCUMENTS

| | | | |
|---|---|---|---|
| 3,326,374 | 6/1967 | Jones | 209/232 |
| 3,838,773 | 10/1974 | Kolm | 209/223.1 |
| 3,902,994 | 9/1975 | Maxwell et al. | 209/232 |
| 4,087,358 | 5/1978 | Oder | 209/214 |
| 4,191,591 | 3/1980 | Bender et al. | 209/214 |
| 4,266,982 | 5/1981 | Bender et al. | 209/214 |
| 4,414,116 | 11/1983 | Nolan | 210/695 |

FOREIGN PATENT DOCUMENTS

| | | | |
|---|---|---|---|
| 0012723 | 1/1984 | Japan | 210/695 |

*Primary Examiner*—Robert B. Reeves
*Assistant Examiner*—Donald T. Hajec
*Attorney, Agent, or Firm*—Inez L. Moselle

[57] ABSTRACT

A process which is especially useful for effecting magnetic separation of magnetically attractable impurities from an aqueous clay slurry or suspension includes passing the suspension through a porous, ferromagnetic matrix while applying a magnetic field to the matrix, on which impurities are collected, and thereafter regenerating the matrix by flushing collected impurities therefrom with a flush liquid, e.g., water. The improvement comprises, after discontinuing the passage of the suspension through the matrix, but before passing flush liquid therethrough, admitting a pressurized gas, e.g., compressed air, into the separator to displace suspension retained therein, and recovering the displaced suspension. In addition, flush liquid retained in the matrix after the flushing step may be displaced therefrom by the compressed air. By displacing the retained suspension from the matrix with, e.g., compressed air, instead of a flush liquid, e.g., water, the retained suspension is not diluted by flush water and is recovered instead of sewered as in the prior art processes.

13 Claims, 2 Drawing Sheets

PROCESS FOR REMOVING MAGNETIC PARTICLES FROM A SUSPENSION OF SOLIDS IN A LIQUID

BACKGROUND OF THE INVENTION

1. Field Of The Invention

The present invention relates to removal of magnetically attractable impurities from suspensions of solids in a liquid vehicle by wet magnetic separation, e.g., by high intensity magnetic separation of magnetically attractable impurities from aqueous clay suspensions.

2. Description Of Related Art

In the processing of clay materials, it has been common practice in the art to utilize high intensity magnetic field separation for the removal from aqueous clay suspensions of paramagnetic (weakly magnetic) colorant impurities, e.g., iron-bearing titania and ferruginous impurities. For example, kaolin clays frequently naturally occur with such colorant impurities which impart undesired color or tint to the clay product. Both the colorant impurities and the clay particles are usually very finely divided, characteristically in the micron-size range, with much of the impurity existing as particles having an equivalent diameter of two microns or less. Magnetic separation has been found to be useful in separating the colorant impurities from slurries, i.e., aqueous suspensions, of such clay particles in order to enhance brightness of the clay.

A common type of high gradient magnetic separator apparatus employs a porous ferromagnetic matrix, e.g., stainless steel wool, which is contained in a vertically oriented cylindrical canister enclosed within an electromagnetic coil. At the upper and lower ends of the canister, ferromagnetic pole caps are disposed within the coil and a ferromagnetic return frame surrounds the coil to confine the magnetic field. Inlet and outlet openings in the canister intersecting the pole caps and return frame are provided for the aqueous clay suspension. In operation of a magnetic separator of this type, an aqueous slurry or suspension of clay containing magnetic colorant impurities is dispersed and degritted upstream of the magnetic separator and is introduced via the inlet at the bottom of the canister. The clay suspension passes through the magnetized collector which, under influence of its magnetic field, collects magnetizeable impurities in the slurry, and the resultant slurry of clay brightened by removal therefrom of the magnetically attractable impurities is withdrawn from the outlet at the top of the canister.

The electromagnetic coil is energized by a source of DC current to produce a high background field strength and set up regions of high magnetic gradient in the (e.g., steel wool) porous matrix or collector which provides numerous collection sites for the paramagnetic colorant impurities in the clay. The paramagnetic colorant impurities are collected and retained on the steel wool matrix, and, after a period of such treatment, the matrix must be cleaned of accumulated impurities. This is accomplished by discontinuing the treatment operation and flushing the matrix with water to remove the retained paramagnetic colorant impurities. The porous matrix inherently tends to retain liquids therein, including the suspension of clay solids and so a considerable quantity of clay product is flushed from the matrix by the flush water. Due to the volumes of flush water required for cleaning the matrix of the accumulated impurities, it is uneconomical to recycle the effluent flush water for processing to recover the clay solids therein, because the resultant high degree of dilution of the process stream would impose an uneconomic dewatering burden on the process. That is, the energy and equipment costs necessary to remove the added flush water from the clay suspension to attain a solids level suitable for shipping or end use of the product clay would exceed the value of the recovered clay. See, in this regard, U.S. Pat. No. 3,819,515 to J. W. Allen, and U.S. Pat. No. 4,087,358 to R. R. Oder.

The Oder patent is primarily directed to improvements in flushing collected impurities from magnetic separation matrices by applying auxiliary mechanical forces to dislodge the magnetics from the deposition medium. After processing a clay slurry during what is described as an initial phase of slurry feed (column 4, line 38 et seq) the magnetic separator is rinsed during a second phase of the typical operation cycle (column 4, line 54 et seq ) by rinse water flowed through it in the same direction as slurry flow (column 5, lines 1–2) while the magnetic field is still activated. The resultant rinse water-diluted slurry is withdrawn from port C of valve 52 as what the patentee states may be regarded as a "middlings" fraction, "which can be reprocessed or processed as a portion of the non-magnetics" (column 4, lines 66–68). During a third phase of the operating cycle (column 5, line 3 et seq) a high pressure flushing flow is passed through the canister in the direction opposite to that of the initial phase slurry flow and the second phase rinse flow. After this third phase of operation, treatment of the slurry is reinitiated, i.e., the first phase is repeated. At column 5, line 64 to column 6, line 10, the patentee discloses that a magnetic separator inevitably produces waste during such a cycle of operations because, after flushing, the canister "remains filled with the flush water—which then must be displaced as the processing of product is reinitiated." The patentee points out that, in turn, this displacement of flush water with product requires discarding of initial fractions of the product upon reinitiating treatment of product until complete displacement of flush water from the product, with its attendant dilution of the product, is attained. The patentee teaches to overcome this waste of product by, subsequent to flushing the magnetic separator, introducing compressed air to it to displace all of the flush water remaining in the canister and thus leaving the canister empty and ready for reinitiation of processing. However, the patentee does not teach or suggest the use of compressed air to remove retained product from the magnetic separator, but rather displaces it with rinse water to produce a "middings" fraction as described above. The patentee therefore teaches away from any suggestion of using compressed air for removal of retained product from the separator for any purpose, and entirely fails to appreciate the possibility of avoiding or reducing dilution and obtaining product yield improvement by such compressed air product removal.

U.S. Pat. Nos. 3,326,374 to G. H. Jones and 4,266,982 and 4,191,591, both to H. Bender et al, describe cleaning a magnetic separation matrix with both liquid and gaseous media.

SUMMARY OF THE INVENTION AND ITS ADVANTAGES

In accordance with the present invention there is provided an improvement in a method for effecting wet magnetic separation of magnetically attractable particles from a suspension of solids in a liquid vehicle. The method includes passing the suspension containing such particles upwardly through a porous, ferromagnetic matrix, e.g., a body of filamentary, ferromagnetic material, contained in a canister while applying a magnetic field to the matrix, periodically flushing the matrix with a flush liquid to remove magnetically attractable particles collected therein, and thereafter resuming the passing of the suspension through the matrix. The improvement provided by the present invention comprises (a) discontinuing the passing of the suspension through the matrix and thereafter passing a pressurized gas downwardly through the matrix to displace retained suspension therefrom, all while continuing to apply the magnetic field to the matrix; and (b) recovering the displaced suspension.

Another aspect of the invention includes flushing the matrix after completion of step (a) by discontinuing application of the magnetic field while passing the flush liquid through the matrix, and thereafter passing a pressurized gas downwardly through the matrix to displace retained flush liquid therefrom.

In another aspect of the present invention, there is provided a method for effecting wet magnetic separation of magnetically attractable particles from a suspension of solids in a liquid vehicle, including periodic flushing of a matrix on which such particles are collected, the method comprising the following steps. (a) Passing the suspension containing the magnetically attractable particles upwardly through a stationary ferromagnetic matrix while applying a magnetic field to the matrix to collect the particles on the matrix, the matrix having the property of retaining therein, respectively, suspension and flush liquid after discontinuation of passing of these materials through the matrix. (b) After conducting step (a) for a selected treatment period, maintaining the magnetic field applied to the matrix while discontinuing the passing of the suspension through the matrix and passing a pressurized gas downwardly through the matrix to displace retained suspension from the matrix. (c) After step (b), discontinuing the magnetic field and flushing the matrix by passing a flush liquid therethrough in the absence of the magnetic field to flush collected impurities from the matrix, and thereafter passing a pressurized gas downwardly through the matrix to displace retained flush liquid therefrom, (d) recovering the displaced suspension of step (b), and (e) repeating the above steps for a plurality of cycles.

Generally, the present invention broadly encompasses the use of a pressurized gas to displace retained suspension from a matrix and recover the displaced suspension, and preferably also encompasses the use of a pressurized gas to displace flush liquid, e.g., flush water from the matrix. Practice of the invention reduces or minimizes dilution of the magnetically-treated product and provides four distinct advantages, as follows. (1) The yield of the treatment process is improved as a result of recovering the gas-displaced suspension, instead of incurring the loss of flush water-displaced suspension which must be discarded because of its high dilution. (2) A final product of higher solids content is obtained, which reduces the cost of downstream dewatering needed to attain a desired final product solids content. (3) In cases where the recovered displaced suspension is recycled through the magnetic separator, purity of the magnetically treated product is increased because some of the suspension is treated twice. (4) Operation of the system can be simplified and automated, instead of having to rely on operator skill and know-how. These advantages are discussed more fully below in the Detailed Description of the Preferred Embodiments.

While broadly applicable to the removal of magnetically attractable particles suspended in a liquid, the present invention is particularly well adapted for use in operations in which the material to be treated is an aqueous suspension of clay particles containing magnetically attractable particles comprising impurities, such as clay colorant impurities. To illustrate, the clay particles may be kaolin clay particles and the impurities may be colorant impurities naturally occurring in the clay such as, for example, one or more of iron, titanium and their oxides. The flush liquid may be water and the pressurized gas may be air.

DETAILED DESCRIPTION OF THE PREFERRED EMBODIMENTS

Figure 1:
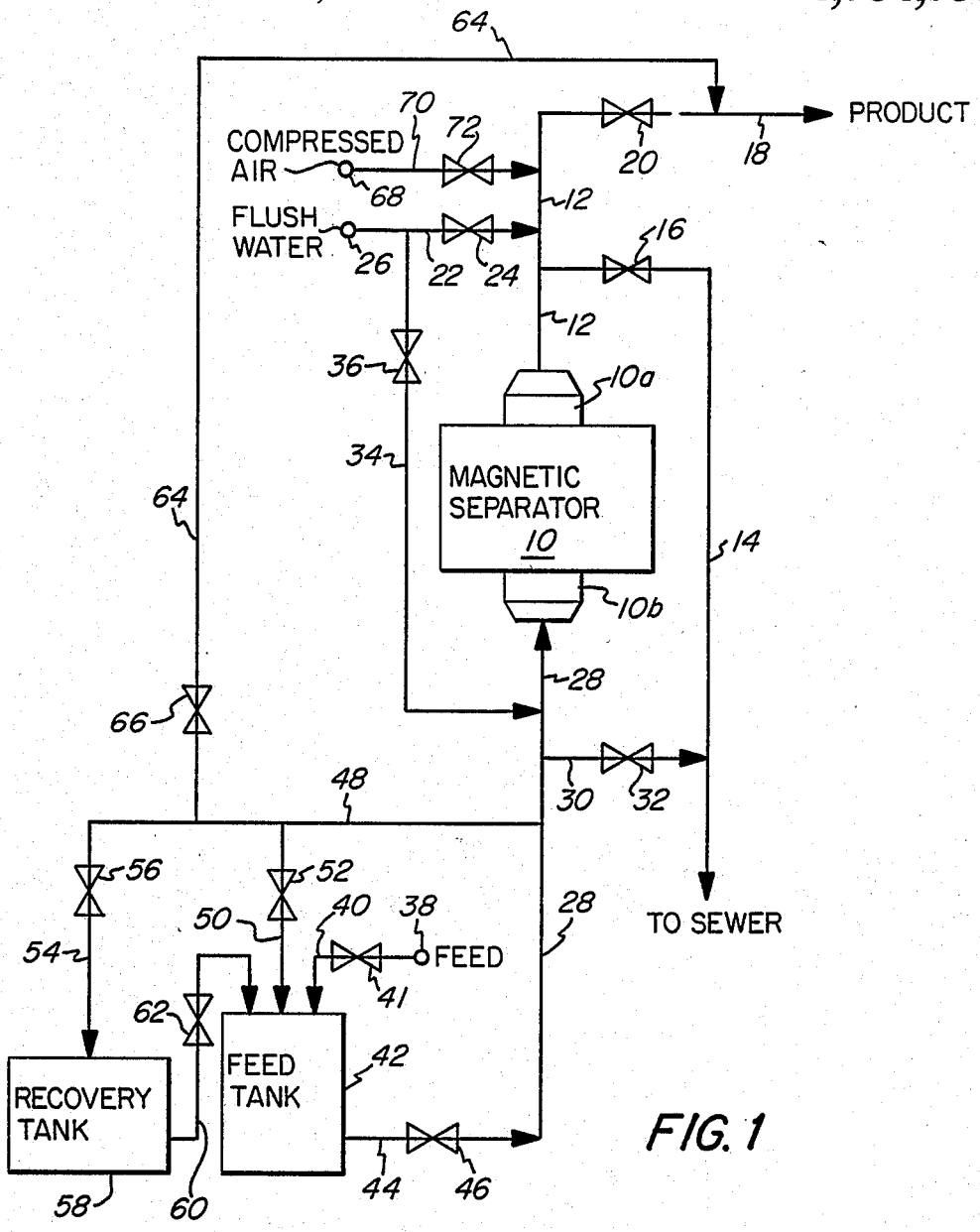
FIG. 1 is a simplified, schematic block diagram of a system for removing magnetic impurities from a liquid suspension or slurry, in accordance with one embodiment of the process of the present invention.

Referring to FIG. 1, it is to be understood that for the sake of simplicity the schematic illustration omits numerous necessary and conventional items, such as pumps, bleed lines, controls and the like, the use of which is well known to those skilled in the art and the description of which is not necessary for explaining the present invention.

A magnetic separator is schematically indicated at 10 and may be a conventional canister-type design wherein a porous, ferromagnetic matrix comprising a body of stainless steel wool is confined within a vertical, enclosed canister of generally cylindrical configuration. The canister is surrounded by an electromagnetic coil, ferromagnetic pole caps, and a ferromagnetic frame surrounding the coil and the canister. Such type of magnetic separator will have a suitable power supply means connected to it by suitable circuitry to generate a magnetic field intensity sufficient to magnetize weakly magnetizeable particles contained in a liquid suspension, e.g., an aqueous slurry of clay particles, passed through it. Alternatively, there may be used any other suitable configuration of magnetic separator having a magnetizeable collector, e.g., a porous ferromagnetic mass on which magnetic impurities are collected under the influence of the applied magnetic field. As used herein and in the claims, a "porous" matrix means one through which a liquid or a suspension of fine particulate solids in a liquid vehicle, such as a suspension of fine clay particles in water, can be passed and which tends to retain such liquid or suspension within the interstitial spaces of the matrix after discontinuation of passing of the liquid or suspension therethrough, the retained liquid or suspension draining but slowly and incompletely from the matrix. For example, as described in more detail below, a commercially available form of porous matrix comprises a stainless steel wool pad, the filaments of steel being packed within the canister to a density such that about 92% to 96% of the volume of the pad comprises interstitial voids, the steel filaments occupying only about 4% to 8% of the volume of the pad. Such porous matrices, having considerable interstitial void volume, act somewhat in the nature of a sponge, in that they tend to retain the liquid, e.g., water, or the suspension therein for at least a time after cessation of pumping or otherwise passing the liquid or suspension therethrough.

The present invention, which provides for displacing such retained suspension from the matrix with a pressurized gas, is generally applicable to any useful set of process conditions. Typically, the magnetic separator equipment is operated at a magnetic field intensity of about 5 to 30 kilogauss, say about 8.5 to 20 kilogauss, and the pressurized gas, e.g., compressed air, used to displace retained suspension and, optionally, retained flush water, from the porous matrix may be at a pressure of about 8 to 18 psig, preferably about 10 to 15 psig, e.g., about 13 psig. At these pressures of compressed air, reasonably rapid displacement of retained suspension is attained without dislodgement into the suspension of collected impurities from the matrix, or at least without an unacceptably high degree of such dislodgement. In order to reduce or avoid such dislodgement of collected impurities, it is helpful to introduce the pressurized gas into the suspension-retaining matrix and pass it therethrough in a non-pulsating and controlled impact manner. Limiting the pressure of the pressurized gas, e.g., to a range of from about 8 to 18 psig, and gradual opening of the air valve helps to control the initial impact. Passing the pressurized gas in a continuous stream, i.e., without significant pulsations or pressure variations, avoids pressure fluctuation impacts on the matrix.

The present invention, especially when carried out in the preferred embodiment in which a pressurized gas, e.g., compressed air, is used to displace from the matrix not only retained feed suspension, but also retained flush water, provides a means for magnetically purifying suspensions of kaolin clay while minimizing dilution of the feed suspension. The ability to minimize such dilution is of practical benefit when beneficiating dispersed clay slurries having solids levels conventionally used in the clay industry, e.g., suspensions of 25% to 35% solids. It is well known in the art, however, that when processing kaolin suspensions at these conventional solids levels, it is necessary to remove large amounts of water from the wet processed suspensions before they can be economically dried by means such as spray drying, or before the beneficiated olay can be supplied as a high-solids slurry suitable for shipment, e.g., a suspension having a solids content above about 60%. A copending patent application of M. J. Willis et al, filed concurrently herewith, discloses a process for wet processing clay at high solids which results in a beneficiated clay product also having a high-solids content. As described in detail in the copending Willis et al patent application, all processing steps, including wet magnetic separation, are carried out at high-solids content, e.g., at least 50% solids and preferably higher, e.g., at least 60% solids. The processing steps include blunging crude kaolin clay at high solids, fractionating the blunged clay to provide one or more fractions of clay of desired particle size, physical removal of the colored impurities by wet magnetic separation as disclosed herein and, optionally but preferably, bleaching. The brightened, beneficiated clay product is obtained as a dispersed aqueous suspension having a solids level which is ideally not lower than that of the feed suspension to the initial processing steps. It will be readily apparent to those skilled in the art that the present invention is of especial significance in such a scheme for high-solids processing, or for other conceivable schemes for beneficiating kaolin clay in which the feed clay to the wet magnetic separator has a high-solids content which should be maintained in the magnetically purified product. Thus, one particularly advantageous mode of carrying out the present invention involves the use of clay feed suspension that is at a high-solids level of, e.g., about 50% solids or above and, most preferably, about 60% solids. In this regard, see Examples 5, 6, and 7 of this application.

Referring again to FIG. 1, communicating with the outlet end 10*a* of the magnetic separator 10 is a manifold conduit 12 joined to a sewer line 14 containing control valve 16 therein and communicting with a sewer or other disposal means. A product line 18 having control valve 20 therein is also joined in communication with manifold conduit 12 to convey purified product to further processing or storage. A flush water line 22 having a control valve 24 therein connects manifold conduit 12 to a source of flush liquid such as flush water inlet 26. A pressurized gas source, in the illustrated embodiment a compressed air source 68, is connected via compressed air line 70 to manifold conduit 12 and has a control valve 72 located therein.

At the inlet end 10*b* of the magnetic separator 10, a manifold conduit 28 has connected to it a discharge line 30 which is fitted with a control valve 32 and in turn connects to sewer line 14, thereby connecting the inlet end 10*b* of magnetic separator 10 to sewage or other disposal. A second flush water line 34 has a control valve 36 therein and connects flush water inlet 26 via manifold conduit 28 to the inlet end 10*b* of magnetic separator 10.

A feed source 38 supplies a feed to be treated, such as an aqueous dispersion of kaolin clay particles containing magnetic colorant impurities, to a feed tank 42 via a feed supply line 40 having a control valve 41 therein. A feed inlet line 44 leads from feed tank 42 and has a control valve 46 mounted therein for the controlled introduction of feed into manifold conduit 28. A return line 48 from manifold conduit 28 branches into a feed tank return line 50, which has a control valve 52 therein, and a recovery tank line 54, which has a control valve 56 therein. Feed tank return line 50 connects to feed tank 42 and recovery tank line 54 connects to a recovery tank 58. A transfer line 60 has a control valve 62 therein and connects to feed tank 42. A secondary product line 64 has a control valve 66 therein and connects return line 48 to product line 18.

In operation, an aqueous clay suspension containing magnetic impurities is flowed from feed source 38 via feed supply line 40 into feed tank 42 in which a suitable inventory of feed is retained. From feed tank 42, the clay suspension is passed through feed inlet line 44, control valves 20 and 46 being open and the other valves closed, except for valve 41 which is opened as needed to keep a sufficient inventory in feed tank 42. The feed slurry flows through manifold conduit 28 and then through magnetic separator 10, entering inlet end 10*b*, passing through the porous stainless steel matrix (not shown) within separator 10 and exiting via outlet end 10*a*. Magnetic impurities, under the influence of the magnetic field maintained on the matrix in magnetic separator 10, are retained on the matrix of separator 10 which, as described above, comprises a suitable porous ferromagnetic body, such as a body of stainless steel wool. The resultant magnetic impurities-depleted slurry flows via manifold conduit 12 into product line 18, to further processing or product storage.

The passage of aqueous clay suspension through the magnetic separator 10 is continued with the power source associated with the magnetic circuitry of the separator being continuously actuated to maintain the magnetic field continuously applied to the matrix while the suspension is being flowed therethrough. When a predetermined time has elapsed, or when the matrix has become saturated with collected magnetic impurities or has accumulated a sufficient quantity of such impurities that removal efficiency of the separator 10 has been reduced to a minimum acceptable level, the matrix is regenerated, i.e., cleaned, by removal of collected impurities therefrom.

The length of treatment time before cleaning of the matrix becomes necessary will be a function of the clay suspension being processed, the configuration and characteristics of the magnetic separator, the process conditions such as volumetric flow rate of the clay suspension through the separator, and the type and concentrations of the impurities present in the clay suspension being processed. The magnetic impurities commonly associated with kaolin clays may comprise, for example, one or more of iron, titanium and their oxides, e.g., ferruginous and titania minerals, including colored titania minerals such as iron-stained anatase.

When it becomes necessary to clean the porous matrix, the passage of the clay suspension through the magnetic separator 10 is terminated by closing valves 46 and 20 but maintaining the magnetic field circuitry energized. Valves 72 and 52 are then opened, with all other control valves being closed, in order to introduce a continuous stream of pressurized gas, e.g., compressed air, from compressed air source 68 through compressed air line 70 into manifold conduit 12 and thence into magnetic separator 10 downwardly through the matrix thereof to displace clay suspension retained in the porous matrix. It is a characteristic of the porous ferromagnetic matrix, such as a bed of stainless steel wool, to retain therein a considerable body of suspension or liquid, e.g., the suspension of clay solids being treated or flush water used to clean the matrix, after flow of the suspension or liquid through the matrix is terminated. Such retained suspension of the clay solids being treated is forced by the compressed air through manifold conduit 28 and feed tank return line 50 into feed tank 42. The magnetic field is maintained continuously applied to the matrix during discontinuation of the suspension flow therethrough and the pressurized gas displacement of retained suspension, in order to hold the magnetically attractable particles in place on the matrix. The suspension which was retained in the matrix upon discontinuation of the flow of suspension therethrough is thus recovered and recycled to feed tank 42 for eventual reconveyance to separator 10 for treatment. Alternatively, valve 52 may be closed during all or a selected stage of such pressurized gas displacement from the matrix of the retained suspension, while either or both of valves 56 and 66 are open, so that the displaced suspension is fed via recovery tank line 54 into recovery tank 58, and/or via secondary product line 64 to product storage or further treatment. Most, if not all, of the magnetically attractable impurities in the suspension displaced from the matrix of magnetic separator 10 by the compressed air are retained on the matrix, the magnetic field having been maintained during the displacement step. Therefore, it may be economical to incorporate all or part of the displaced retained suspension into the product (via secondary product line 64). On the other hand, all or part of the displaced suspension may be sent to recovery tank 58 from which it is transferred to feed tank 42 in desired proportions with fresh feed and recycled for treatment in magnetic separator 10.

Regardless of the specific disposition (to feed tank 42, recovery tank 58 or product line 18) of the recovered solids-containing suspension, because it was displaced from the matrix of magnetic separator 10 by compressed air and not by flush water, the recovered suspension is not diluted. Further, because the magnetic field circuitry is maintained continuously energized during displacement of suspension from the matrix, the magnetically attractable particles are retained on the matrix during the displacement.

Following the recovery of the displaced suspension, valve 72 (and/or valves 52, 56 and/or 66) are closed, the magnet is de-energized and valves 36 and 16 are opened and all other valves closed to forward-flush the porous matrix in magnetic separator 10 by passing flush water through separator 10 in the same or upward (as viewed in FIG. 1) direction of flow as the suspension is flowed during treatment. The flush water and impurities displaced by it from the porous matrix of separator 10 are discharged via manifold conduit 12 and sewer line 14. After a period of such forward flushing, valves 36 and 16 may be closed and valves 24 and 32 opened (with all other valves closed) to backflush the matrix of magnetic separator 10 by passing flush water downwardly (as viewed in FIG. 1) therethrough. During such back-flushing, which may be followed by another period of forward-flushing, flush water and magnetic impurities displaced by the flush water from the matrix of separator 10 flow through the manifold conduit 28, discharge line 30 and sewer line 14. After flushing of the matrix of magnetic separator 10 has been completed, valve 24 is closed and valve 72 is opened, so that compressed air from the compressed air source 68 flows into magnetic separator 10 through compressed air line 70, manifold conduit 12 and manifold conduit 28, downwardly through the matrix of separator 10 to displace from it retained flush water. The displaced flush water flows through discharge line 30 and sewer line 14 to sewer disposal. After retained flush water has thus been displaced from the matrix of magnetic separator 10 by the compressed air, valves 72 and 32 are closed, the power source for the magnetic circuitry is again actuated, and valves 46 and 20 are re-opened to reinitiate passage of the clay suspension through the magnetic separator 10 to start a fresh treatment cycle.

The present invention is seen to provide the advantage of avoiding the waste, heretofore deemed to be unavoidable, inherent in using a flush liquid, e.g., water, to displace from the matrix suspension or slurry retained therein. The prior art practice of flushing the retained suspension from the porous matrix with water results, as noted above, in such high dilution of much of the flushed suspension by the flush water that it becomes unusable and must be sewered or otherwise disposed of. The amount involved is not inconsequential; a typical porous matrix may comprise a substantially cylindrical shaped bed of stainless steel wool about 20 inches or more deep and from about 80 to 120 inches or more in diameter. A matrix of such size can retain a significant quantity of suspension, much of which is lost by the prior art practice on each regeneration cycle, resulting in an operating loss of economical significance. The adverse economic consequences of the prior art practice of using flush water to displace retained suspension or slurry from the matrix is an incentive to delay cleaning of the matrix for as long as possible and to salvage at least an early fraction of the displaced retained suspension. Therefore, the operation of a magnetic separator using the prior art water flush technique involved a number of complicating factors in deciding when to stop operation and clean the matrix and how much of the flush water-diluted displaced suspension could be recovered. A premium was placed upon operator skill and experience in balancing the decline in brightening capacity of the magnetic separator as the concentration of collected impurities on the matrix increased, versus the economic cost and tolerable degree of dilution inherent in recovering at least a portion of the flush water-displaced suspension. By utilizing the practices of the present invention, in which pressurized air (or other gas) is utilized to displace the retained suspension, substantially all of which may thus be recovered without sustaining a dilution effect, the operation may be put on a simple, predetermined time basis or may be set up to respond to a minimum acceptable degree of brightening as the efficiency in removing the colorant impurities decreases because of the build-up of collected impurities on the matrix. It will be appreciated that the sequence of process steps in the practice of the invention may be automatically controlled by a suitable cycle time controller coupled to automatic flow controllers for the control valves of the equipment, whereby the operation of the system may be completely automated in accordance with the cycle time program. This greatly simplifies control of the process and reduces the need for skilled and experienced operators to take into account numerous factors such as the type of clay being processed and the intended end use of the product as affecting the brightness and percent solids required, etc.

Test runs were conducted in clay processing equipment to compare the method of an embodiment of the invention (the "Exemplary Method") to a conventional method (the "Comparative Method"). In the Exemplary Method, which was used to treat both low-solids and high-solids aqueous suspensions of clay, compressed air is used in two different steps to displace from the matrix both retained clay suspension and retained flush water. In the Comparative Method, flush water is used to displace retained clay suspension from the matrix and clay suspension feed is used to displace retained flush water from the matrix. Prior art methods of wet magnetic separation, such as the Comparative Method, are limited to the treatment of low-solids suspensions, e.g., 25% to 35% solids, because the extent of dilution of the suspension inherent in such prior art methods can not be sustained by a high-solids suspension. Accordingly, the Comparative Method could be employed only on low-solids suspensions.

The comparison tests were run in the same installation using either an 84 inch diameter PEM high intensity magnetic separator or a 120 inch diameter PEM high intensity magnetic separator. In each case, the magnetic separator is connected to suspension feed, flush water and compressed air lines in a manner as generally indicated by the schematic diagram of FIG. 1. The electric power used to energize the electromagnets of the separators was maintained during all tests reported in the Examples at a level to apply a magnetic field of 16 kilogauss to the porous matrices of the separators. The porous matrices comprised substantially cylindrical shaped beds of stainless steel wool, respectively 84 and 120 inches in diameter. In both cases, the stainless steel wool matrix was 20 inches deep and the steel wool was packed within the canister to a density such that about 94% of the volume of the porous matrices comprised voids and about 6% of the volume of the matrices comprised stainless steel. The 84 inch diameter stainless steel wool matrix was encased within a canister of 430 U.S. gallons capacity and the 120 inch diameter stainless steel wool matrix was encased within a canister of 860 U.S. gallons capacity.

In the respective descriptions of the Comparative Method and the Exemplary Method set forth below, the lines and valves described correspond to the numbered items of FIG. 1, as follows: the "feed valve" corresponds to valve 46; the "product line valve" corresponds to valve 20; the "water valve" corresponds to valve 36 for forward (upward) flush through separator 10, and to valve 24 for back (downward) flush through separator 10; the "sewer valve" corresponds to valve 16 for sewering during forward (upward) flow through separator 10, and to valve 32 for sewering during back (downward) flow through separator 10; the "compressed air valve" corresponds to valve 72; and the "recycle valve" corresponds to valve 52.

Generally, as will be appreciated from the respective descriptions of the Comparative Method and the Exemplary Method, the feed treatment periods are carried out in substantially the same manner. A significant difference occurs in step 2 in which the Comparative Method utilizes flush water to displace product from the matrix and recovers an initial diluted fraction of the displaced product whereas, in the Exemplary Method, compressed air is used to displace undiluted retained product from the matrix, which product may either be sent to product storage or recycled for further treatment. Flushing of the matrix after removal of retained feed therefrom is carried out in substantially the same way in both the Comparative and Exemplary Methods, but the displacement of retained flush water from the matrix after the respective Matrix Flush steps is quite different. The Comparative Method utilizes fresh feed to displace retained flush water from the matrix, thereby requiring the disposal to waste of an initial highly dilute fraction of the feed, whereas the Exemplary Method utilizes compressed air to displace and recover an undiluted feed from the matrix.

COMPARATIVE METHOD (CONVENTIONAL)

For test runs using conventional techniques, the following procedure was employed to treat low-solids aqueous suspensions of clay.

1. Feed Treatment Period. Energize the magnet, close the water valves, and open the feed valve and product line valve to pass the feed of the aqueous clay suspension to be treated upwardly through the matrix while a 16 kilogauss magnetic field is applied to the matrix. Typical feed rates for wet magnetic treatment of low-solids aqueous clay suspensions were employed, about 300 to 500 gallons per minute for the 84 inch diameter magnet and about 600 to 1000 gallons per minute for the 120 inch diameter magnet.

2. Clay Recovery By Water. While maintaining the magnet in an energized condition, close the feed valve and open the water valve and product line valve to flow 300 gallons per minute of flush water upwardly through the matrix and flow the displaced (and eventually diluted) suspension to product.

3. Clay Purge. At a predetermined maximum allowable dilution of the clay suspension, close the product line valve, de-energize the magnet and open the sewer valve to continue to flow upwardly through the matrix and to the sewer the very dilute clay suspension being purged from the matrix by the flush water.

4. Matrix Flush. Open water valve to flow flush water upwardly through matrix to flush magnetically attractable particles from the matrix to sewer. For the 84 inch diameter magnet, a flow rate of about 1200 to 1500 gallons per minute was employed and for the 120 inch diameter magnet a flow rate of about 2000 to 2200 gallons per minute was employed. Reverse direction of flow of flush water after an initial period to back-flush matrix, and then finish with an additional period of forward flow (upwardly) through matrix.

5. Displace Water. Energize magnet, open feed valve to pass feed upwardly through the matrix, keeping the sewer valve open and product line valve closed in order to displace, with the feed, flush water retained in the matrix, and flow the resultant highly diluted suspension to sewer.

6. End Cycle. At a predetermined acceptable dilution level (minimum acceptable solids content), close valve to sewer and repeat step 1 above to initiate another treatment period.

EXEMPLARY METHOD (IN ACCORDANCE WITH AN EMBODIMENT OF THE INVENTION)

For test runs using a technique in accordance with an embodiment of the present invention, the following technique was employed for wet magnetic treatment of both low-solids and high-solids aqueous clay suspensions.

1. Feed Treatment Period. Energize the magnet, close the water and air valves, and open the feed valve and product line valve to pass the feed of the aqueous clay suspension to be treated upwardly through the matrix while a 16 kilogauss magnetic field is applied to the matrix. The feed rates of the aqueous clay suspension are the same as those of the Comparative Method.

2. Clay Recovery By Compressed Air. While maintaining the magnet in an energized condition, simultaneously close the feed valve and product line valve, and open the compressed air valve and recycle valve, to provide a continuous compressed air force at 13 psig to displace suspension retained in the matrix back into the feed tank or into the recovery tank. (It should be noted that suspension in the matrix has been magnetically processed at the time of displacement of it from the matrix. Thus, additional overall brightness improvement can be obtained by sending it back to the feed tank for eventual recycle through the magnetic separator. However, should the alternate procedure of sending the displaced suspension to the recovery tank be chosen, brightened product can be obtained directly from the recovery tank.)

3. Matrix Flush. Close compressed air valve and recycle valve, de-energize the magnet, and open flush water valve and sewer valve to flow flush water upwardly through the matrix to flush magnetically attractable particles from the matrix to sewer. The same flow rates as used in the Comparative Method were used, i.e., about 1200 to 1500 gallons per minute for the 84 inch diameter magnet and about 2000 to 2200 gallons per minute for the 120 inch diameter magnet. Reverse direction of flow of flush water after an initial period to back-flush matrix and then finish flush with additional period of forward flow (upwardly) through matrix.

4. Displace Water. Close flush water valve and open compressed air valve and sewer valve to continuously flow compressed air at 13 psig downwardly through the porous matrix to force flush water retained in the matrix to the sewer. In the treatment of low-solids clay suspensions, the compressed air was applied for 45 seconds and in the treatment of high-solids clay suspensions the air was applied for 120 seconds. (The reason for the different time periods is explained below.)

5. End Cycle. Close compressed air valve and sewer valve and repeat step 1 to initiate another treatment period.

Step 4, the "Displace Water" step of the Exemplary Method, was carried out for only 45 seconds when treating low-solids clay suspensions because it was deemed that the greater production rate (tons of clay processed per cycle) attained by shortening the cycle time required for this step warranted accepting the higher flush water dilution that ensued. Higher flush water dilution is sustained because residual flush water retained in the matrix due to the reduced duration of the "Displace Water" step diluted the feed suspension introduced in the next cycle. In the treatment of high-solids clay suspensions, the production rate is high because of the greater solids content per gallon of suspension, and more cycle time was devoted to the "Displace Water" step in order to more completely remove flush water from the matrix and correspondingly reduce dilution of the high-solids suspension feed to the matrix in the next cycle. Balancing the cycle time devoted to the "Displace Water" step 4 of the Exemplary Method against the amount of flush water so displaced will depend on the economics in a given case of the relative values of production rate and amount of dilution sustained. In any case, significant removal of flush liquid by the pressurized gas is employed, e.g., removal of at least about one-third, preferably at least about two-thirds, of the retained flush liquid by the pressurized gas.

Figure 2:
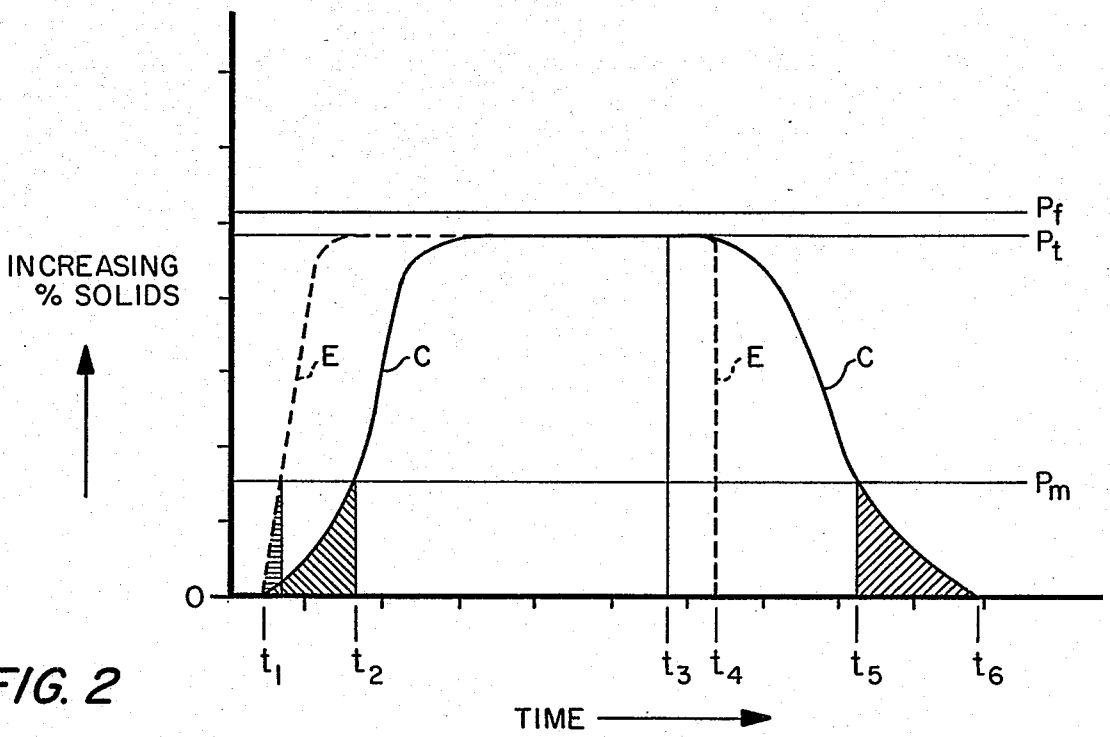
FIG. 2 is a plot showing typical percentage of solids in a suspension discharged from a magnetic separator during a magnetic separation treatment cycle.

The differences with respect to the yields provided by, respectively, the Comparative and Exemplary Methods is graphically illustrated in FIG. 2 which plots on the vertical axis percent solids of the suspension feed against, on the horizontal axis, time. Dash line E represents the Exemplary Method and solid line C the Comparative Method and shows the percent solids in the discharge from the magnetic separator (10 in FIG. 1) at various times during the process. Referring now to the solid line curve C of the Comparative Method, time $t_1$ corresponds to the commencement of step 5, the "Displace Water" step. Clay suspension feed is introduced into the matrix of the magnetic separator which is laden with retained flush water. The percent solids of the material being discharged from the matrix is accordingly initially zero at the initial displacement of water and gradually builds up as flush water is displaced from the matrix and replaced with clay suspension. At time $t_2$ the percent solids attains the value $P_m$, which is the minimum acceptable percent solids which can be tolerated in the product, i.e., the predetermined acceptable dilution level mentioned in "End Cycle" step 6 of the Comparative Method. "Feed Treatment Period" step 1 of the Comparative Method now commences and the percent solids increases until it attains the value $P_t$, which is the percent solids content of the product leaving the porous matrix during the steady state portion of the step 1 "Feed Treatment Period". Reduction of the solids content by separation of the magnetically attractable impurities is a factor in reducing the solids content to the value $P_t$, which is somewhat less than the solids content value $P_f$, which is the percent solids content of the feed to the process. The Exemplary Method of the invention, as explained in detail below, sustains substantially less dilution than does the Comparative Method of the prior art. Thus, for a given feed solids value $P_f$, the solids value $P_t$ will be greater for the Exemplary Method than for the Comparative Method. However, for the sake of simplicity of illustration and comparison, a single value for $P_t$ is shown as common to the Exemplary and Comparative Methods. At time $t_3$, the "Clay Recovery By Water" step 2 of the Comparative Method is initiated. Time $t_3$ is determined either by a predetermined treatment time cycle or by incipient or actual saturation of the matrix with collected impurities or incipient or detected decrease in clay brightness attained by the process. In any event, in step 2 of the Comparative Method flush water is introduced into the matrix to displace retained clay suspension therefrom. Initially, the displaced clay suspension shows a solids content of $P_t$ as a front of substantially undiluted clay suspension is displaced from the matrix by the flush water. However, as flush water replaces and dilutes clay suspension, the percent solids value drops off until at time $t_5$ it declines to the predetermined maximum acceptable dilution $P_m$ at which time the "Clay Purge" step 3 of the Comparative Method is initiated, with the highly dilute clay suspension being sewered together with impurities retained on the matrix. At time $t_6$ the clay suspension and collected solid impurities are flushed from the porous matrix and the solids content is at or near zero. The treatment cycle is then repeated. The diagonally crosshatched sections under curve C represent the clay solids losses to sewer encountered during the Comparative Method. The losses between times $t_1$ and $t_2$ represent the loss by sewering of clay solids in that portion of the feed suspension which is highly diluted by the matrix-retained flush water it is displacing from the matrix. The losses between times $t_5$ and $t_6$ represent clay solids lost during displacement from the matrix by flush water of retained feed suspension and the sewering of the resultant highly dilute suspension during the latter stage of that step.

In order to facilitate comparison, dash line curve E of the Exemplary Method is shifted horizontally relative to curve C so that time $t_1$ represents on curve E the commencement of "Feed Treatment Period" step 1. The rate of percent solids increase starting at time $t_1$ of curve E is greater than that of curve C because much or most of the flush water retained in the matrix has (in "Displace Water" step 4) been displaced from the matrix by compressed air. Accordingly, dilution of the clay suspension fed to the matrix is greatly lessened, the maximum acceptable dilution level $P_m$ is attained much more rapidly, and solids losses are avoided because the degree of dilution is so small that even the initial discharge from the matrix may be sent to product. At time $t_3$, step 1 is terminated and "Clay Recovery By Compressed Air" step 2 is commenced, but in this case by the utilization of compressed air. Consequently, the percent solids of the suspension discharged from the matrix remains at the percent solids level $P_t$ and then drops precipitately as the matrix is cleared by the compressed air of retained feed suspension. Consequently, solids losses at this part of the cycle are substantially eliminated.

As well illustrated by FIG. 2, it is seen that significant reductions in clay solids losses are provided by the Exemplary Method as compared to the Comparative Method both in the $t_1$ to $t_2$ time frame and the $t_4$ to $t_6$ time frame. As shown by the $t_1$ to $t_2$ segment of FIG. 2, the Exemplary Method provides reduced dilution by pressurized gas displacement from the matrix of a substantial portion, if not all, of the flush liquid by pressurized gas, with only the remaining flush liquid displaced from the matrix by the feed suspension which sustains little or nearly no dilution thereby. In contrast, the Comparative Method uses the feed suspension to displace all the retained flush liquid from the matrix, sustaining significant dilution thereby. Further, as shown by the $t_4$ to $t_6$ segment of FIG. 2 the Exemplary Method substantially eliminates solids losses by displacing with pressurized gas retained product suspension from the matrix, and recovering or re-cycling the displaced suspension. In contrast, the Comparative Method uses the flush liquid to displace feed suspension from the matrix resulting in dilution of the displaced slurry to an extent that, as a practical matter, requires sewering of the most highly diluted portion of the displaced suspension and acceptance of significant dilution of the retained portion. Thus, using a pressurized gas in accordance with the teachings of the invention to displace retained suspension from the porous matrix effects a substantial portion, usually the larger portion, of the efficiencies provided by the method of the present invention. In fact, significant improvements would be attained as compared to prior art techniques if the pressurized gas were used solely to displace feed suspension from the porous matrix, with flush liquid being displaced from the matrix entirely by the feed suspension.

All reference to particle sizes in this specification and claims are to sizes as determined by use of a SEDIGRAPH® 5000 particle size analyzer and are reported on the basis of maximum equivalent spherical diameter of a stated weight percentage of the material. Similarly, all references to GE brightness refers to GE brightness as measured by the Technical Association of the Pulp and Paper Industry (TAPPI) Standard T452-M-58.

EXAMPLE 1

An aqueous suspension of dispersed kaolin clay particles having an average feed solids of 32.0 percent were treated in a performance test of the Comparative Method as described above, using the above-described 84 inch magnet. The clay suspension had a nominal particle size of 80% by weight finer than 2 microns equivalent spherical diameter. The performance test took place over a period of fifteen consecutive days monitored during three of the fifteen operational days for product brightness and yield. A similar aqueous clay suspension having an average solids content of 32.2% and a nominal particle size of 80% by weight finer than 2 microns was then treated in a performance test of the Exemplary Method as described above over a period of fourteen consecutive days and was monitored for two of the operating days. Both performance tests were carried out in the same equipment and in the Exemplary Method, the "Displace Water" step 4 was carried out for only 45 seconds, in order to enhance productivity, accepting concomitant increased dilution of the brightened clay product. The solids content of the respective products obtained from the two methods of treatment are shown in Table I.

TABLE I

| Method | Average Solids: Clay Feed | Purified Clay Product | Purified Clay Product Yield |
|---|---|---|---|
| Comparative | 32.0% | 25.9% | 92.8% |
| Exemplary | 32.2% | 30.7% | 97.4% |

Table I shows that even when the Exemplary Method is operated in a production-enhancing and dilution-accepting mode, it provided a significantly higher yield than the Comparative Method.

As shown by the data of Table I, the method of the present invention provided a suspension of magnetically purified clay having considerably higher solids, and also provided an increased yield of purified clay solids. The clay suspension treated by the Exemplary Method sustained significantly less dilution by flush water as compared to that treated by the Comparative Method. The reduced percent solids of the product in both cases results not only from dilution of the product with flush water, but also from losses of clay and the removal of magnetically attractable particles from the clay suspension. If one assumes that an average of 16,000 pounds (dry basis) of clay solids are treated during a single treatment cycle, the 4.6 percent improvement (97.4%–92.8%) in yield of the Exemplary Method over the Comparative Method shown in Table I represents an increase of 736 pounds (dry basis) of product per cycle of operation. At a typical cycle time of 18 minutes, this is more than 2,450 pounds (dry basis) of additional clay product per hour of operation.

The extent of flush water dilution sustained by the Comparative Method as compared to the Exemplary Method may be calculated with respect to the data of Table I as follows.

FLUSH WATER DILUTION SUSTAINED BY COMPARATIVE METHOD

A feed composition of 32.0% solids has 7.05 lbs. of water and 3.32 lbs. of clay per gallon of suspension. A product composition of 25.9% solids has 7.34 lbs. of water and 2.57 lbs. of clay per gallon of suspension. Assuming 16,000 lbs. of clay (dry basis) are treated per cycle, and no product or water losses, then:

$$\frac{16{,}000 \text{ lbs. clay}}{3.32 \text{ lbs. clay per gallon}} = 4{,}819 \text{ gallons of feed per treatment cycle}$$

$$\frac{16{,}000 \text{ lbs. clay}}{2.57 \text{ lbs. clay per gallon}} = 6{,}225 \text{ gallons of product per treatment cycle}$$

$$6{,}225 - 4{,}819 = 1{,}406 \text{ gallons of flush water added to product per treatment cycle}$$

FLUSH WATER DILUTION SUSTAINED BY EXEMPLARY METHOD

A feed composition of 32.2% solids has 7.04 lbs. of water and 3.35 lbs. of clay per gallon of suspension. A product composition of 30.7% solids has 7.11 lbs. of water and 3.11 lbs. of clay per gallon of suspension. Assuming 16,000 lbs. of clay (dry basis) are treated per cycle, and no product or water losses, then:

$$\frac{16{,}000 \text{ lbs. clay}}{3.35 \text{ lbs. clay per gallon}} = 4{,}776 \text{ gallons of feed per treatment cycle}$$

$$\frac{16{,}000 \text{ lbs. clay}}{3.11 \text{ lbs. clay per gallon}} = 5{,}145 \text{ gallons of product per treatment cycle}$$

$$5{,}145 - 4{,}776 = 369 \text{ gallons of flush water added to product per treatment cycle}$$

The foregoing dilution calculations are conservative in that they do not take into aooount the reduced solids in the product caused by removal of the magnetically attractable particles. Further, as noted above, in order to enhance the production rate not as much flush water was removed from the matrix by compressed air as might have been. In cases where sustaining less dilution by flush water warrants a larger cycle time between feed treatment periods (as in the treatment of high-solids suspensions) the duration of step 4 "Displace Water" of the Exemplary Method would be increased to displace more of the flush water. In any case, the calculations show a marked reduction in dilution of the product by flush water (a reduction of 1,406−369=1,037 gallons per cycle) provided by operating in accordance with the teachings of the present invention, as compared to operating in accordance with prior teachings.

COMPARISON OF ENERGY REQUIREMENTS FOR SPRAY DRYING

If a high-solids clay feed is to be magnetically treated and then spray dried, the Exemplary Method affords significant energy savings as compared to the Comparative Method. The following calculations are based on assuming a feed solids of 61.5%, the same dilutions as calculated above for the two methods, 16,000 lbs. of clay treated per cycle, and 100% efficiency for the magnetic treatment.

At 61.5% solids, the aqueous clay suspension comprises 5.18 lbs. of water and 8.26 lbs. of clay per gallon, for a density of 13.44 lbs. per gallon of suspension. Accordingly, the feed volume treated per cycle is $$\frac{16{,}000 \text{ lbs. clay}}{8.26 \text{ lbs. clay per gallon}} = 1{,}937 \text{ gallons of suspension}$$

In the Comparative Method, 1,406 gallons of water dilution per cycle is sustained so the volume of the product suspension is $$1{,}937 + 1{,}406 = 3{,}343 \text{ gallons of suspension,}$$

and the percent solids of the product is $$\frac{16{,}000 \text{ lbs. clay}}{3{,}343 \text{ gallons suspension}} = 4.78 \text{ lbs. clay per gallon}$$

$$= 42.4\% \text{ solids}$$

At 42.4% solids, the product comprises 4.78 lbs. of clay and 6.50 lbs. of water per gallon, or 1.36 lbs. of water per lb. of clay.

In the Exemplary Method, 369 gallons of water dilution is sustained per cycle so the volume of the product suspension is 1,937+369=2,306 gallons of suspension, and the percent solids of the product is $$\frac{16{,}000 \text{ lbs. clay}}{2{,}306 \text{ gallons suspension}} = 6.94 \text{ lbs. clay per gallon}$$

$$= 55\% \text{ solids}$$

At 55% solids, the product comprises 6.94 lbs. of clay and 5.68 lbs. of water per gallon, or 0.82 lbs. of water per lb. of clay.

Thus, with the Comparative Method an additional amount of water, amounting to $$1.36-0.82=0.54 \text{ lbs. of water per lb. of clay}$$

must be removed in spray drying.

Assume that about 1,000 BTU per lb. of water is required to heat and evaporate the water content of the product fed to the spray drier, and the spray drier is 75% thermally efficient. Then, the extra energy required for spray drying the 42.4% solids product of the Comparative Method as compared to the 55% solids product of the Exemplary Method is calculated as $$\frac{0.54 \text{ lbs. water}}{\text{lb. clay}} \times \frac{1{,}000 \text{ BTU}}{\text{lb. water}} \times \frac{1}{0.75} = \frac{720 \text{ BTU}}{\text{lb. clay}}$$

720 BTU per lb. of clay is equivalent to 1,440,000 BTU per ton of clay or 14.4 Therms per ton of clay. At an energy cost of $0.40 per Therm ($0.40 per 100,000 BTU), the spray drying energy cost for the product of the Comparative Method is $5.76 per ton of clay more than the spray drying energy cost for the product of the Exemplary Method. Spray drier capacity in terms of dried clay product is of course inversely proportional to the water content of the suspension being dried and so, aside from energy costs, fixed costs associated with operation and maintenance of the drier increase per unit weight of dried clay with increasing water content of the suspension. Of course, in actual practice the 42.4% solids product of the above Example of the Comparative Method would not be spray-dried at that dilution, but would be mechanically de-watered to increase its solids content, typically to a level of 55 to 60% solids.

EXAMPLE 2

Performance tests similar to those of Example 1 were conducted utilizing the above-described 120 inch magnetic separator. An aqueous clay suspension feed similar to that utilized in Example 1 was run in a performance test utilizing the Comparative Method for a ten consecutive day operating period, during two days of which monitoring was carried out to obtain the data set forth below. This was followed by utilizing a similar clay feed in a performance test, carried out in the same equipment, utilizing the Exemplary Method in a 13 consecutive day operating period with two days of monitoring during the 13 day period to obtain the data set forth below. As in Example 1, a 45 second period was used for the "Displace Water" step 4 of the Exemplary Method. The solids content of the products obtained from the performance tests of the two methods of treatment are set forth in Table II below.

TABLE II

| | Average Solids | | |
|---|---|---|---|
| Method | Clay Feed | Purified Clay Product | Purified Clay Product Yield |
| Comparative | 30.3% | 27.5% | 92.9% |
| Exemplary | 32.0% | 30.8% | 97.1% |

Calculations similar to those shown above with respect to Table I show that the product of the Comparative Method sustained a dilution of 2,812 gallons of flush water per cycle and the product of the Exemplary Method sustained a dilution of only 738 gallons of flush water per cycle. Therefore, a reduction of 2,812−738 or 2,074 gallons of dilution per cycle is attained by practicing a technique in accordance with the present invention instead of a prior art technique.

EXAMPLE 3

In order to compare the respective increases in brightness obtained by using the Comparative and Exemplary methods of treatment, the 120 inch magnetic separator used in Example 2 was fitted with a new stainless steel wool matrix and utilized to treat an aqueous clay suspension. The clay was a Washington County, Ga., soft kaolin clay dispersed by an alum-silicate hydrosol as disclosed in U.S. Pat. No. 3,462,013. The clay particles had a particle size of 80% by weight finer than 2 microns equivalent spherical diameter. The first nine consecutive days of operation were carried out in accordance with the Comparative Method described above and the average GE brightness gain for the nine days of treatment by the Comparative Method was 3.13. The same equipment and matrix was then operated for 21 consecutive days in accordance with the Exemplary Method described above and the average GE brightness gain was 4.84. Thus, the brightness-enhancing results attained by the Exemplary Method in accordance with the practice of the invention were better than those attained utilizing the Comparative Method.

Without wishing to be bound by any particular theory, the fact that better GE brightness is attained with the Exemplary Method may be explained by the fact that in the Exemplary Method, clay suspension retained in the matrix at the end of a treatment period was recycled and so passed through the magnetic separator a second time. In the Comparative Method, a portion of the suspension retained in the matrix at the end of a treatment period is sent to product and the remainder is sewered, so none of the suspension passes twice through the separator. With the Comparative Method, dilution of the magnetically treated suspension displaced from the matrix by the flush water precludes recycling of at least the initially displaced portion of the suspension.

EXAMPLE 4

The equipment utilized in Example 3 was used to compare the Comparative and Exemplary Methods in the treatment of an aqueous suspension of soft kaolin clay which was dispersed with a mixture of sodium silicate and soda ash. The clay had a particle size of 80% by weight of the particles finer than 2 microns equivalent spherical diameter. The Comparative Method was run for nine consecutive operating days and then the Exemplary Method was run for 22 consecutive days in the same equipment. The average GE brightness gain for the Comparative Method was 3.80 and for the Exemplary Method was 4.24.

The following Examples 5–7 illustrate embodiments of the invention carried out with high-solids content clay suspensions.

EXAMPLE 5

The 84 inch magnet equipment of Example 1 was used to treat, by the Exemplary Method of the present invention, a high-solids coating clay fraction comprised of two Wilkinson County, Ga. kaolin clays as follows: two parts by weight of a Klondyke coarse, soft kaolin clay and one part by weight of L.D. Smith fine, hard low viscosity clay. The clay was dispersed with approximately 5 lbs. (dry basis) per ton of a dispersant comprising sodium polyacrylate and sodium hydroxide in a 3.50:0.75 weight ratio (dry basis) and had a size range of 82% by weight of the particles finer than 2 microns equivalent spherical diameter. This amount of dispersant is in excess of the amount required to obtain optimum Brookfield viscosity. (Such over-dispersal of the suspension has been found to be advantageous in wet magnetic treatment of high-solids clay suspensions.) The fractionated, degritted clay feed to the magnet contained 61% solids and had an average GE brightness of about 80.3. The magnetic treatment provided a 56% solids product having a brightness improvement of 3.0 GE. The treated product was recycled and identically treated a second time, and a further brightness improvement of 1.7 GE was attained in a product having 51% solids.

EXAMPLE 6

The 84 inch magnet equipment utilized in Example 1 was utilized to treat, by the Exemplary Method of the invention, another portion of a high-solids aqueous suspension of the same clay as treated in Example 5, but having a size range of 78% by weight of the particles finer than 2 microns equivalent spherical diameter. The feed of fractionated, degritted clay was 62% solids and had an average GE brightness of about 80.3 and was dispersed with approximately 5 lbs. (dry basis) per ton of clay of a dispersant comprised of sodium polyacrylate and sodium hydroxide in a 3.50:0.75 weight ratio. Four separate runs were carried out using different operating cycles, as follows:

| Run | Net[1] Tonnage | Residence[2] Time |
|---|---|---|
| 1 | 4 | 2 minutes |
| 2 | 5 | 2 minutes |
| 3 | 5 | 1.5 minutes |
| 4 | 5 | 1.5 minutes |

[1]The Net Tonnage is the total short tons of clay (dry basis) treated in the magnet, less the amount displaced from the porous matrix of the magnet (and eventually re-cycled).
[2]Residence Time is the average residence time of clay within the porous matrix for magnetic treatment.

The following results were obtained:

| Run | Purified Clay Product Percent Solids | GE Brightness Increase |
|---|---|---|
| 1 | 59.0% | 3.2 |
| 2 | 52.4% | 3.1 |
| 3 | 58.9% | 3.2 |
| 4 | 56.6% | 3.4 |

EXAMPLE 7

The 84 inch magnet equipment of Example 3 was used to treat, by the Exemplary Method of the invention, a high-solids aqueous suspension of a hard white clay from the Gibraltar mine, which is located in Wilkinson County, Ga. The clay was dispersed with about 5 lbs. (dry basis) per ton of clay of a dispersant comprising sodium polyacrylate and sodium hydroxide in a weight ratio of 3.50:0.75. This amount of dispersant is in excess of the amount required to obtain optimum Brookfield viscosity. Three separate tests were run and the following results were attained.

| | Clay Feed | | Purified Clay Product | | GE Brightness |
|---|---|---|---|---|---|
| Test | Solids | GE | Solids | GE | Increase |
| 1 | 63.0% | 86.5 | 57.7 | 87.9 | 1.4 |
| 2 | 63.0% | 86.5 | 57.3 | 87.9 | 1.4 |
| 3 | 61.6% | 86.5 | 61.5 | 87.4 | 1.6 |

While the invention has been described in detail with respect to specific preferred embodiments, it will be appreciated that numerous variations to the preferred embodiments may be made which nonetheless lie within the scope of the invention and the appended claims.

What is claimed is:

1. A method for effecting wet magnetic separation of magnetically attractable particles from a suspension of solids in a liquid vehicle, including periodic flushing of a matrix on which such particles are collected, the method comprising the steps of:

(a) passing the suspension containing the magnetically attractagle particles upwardly through a stationary ferromagnetic matrix while applying a magnetic field to the matrix to collect the particles on the matrix, the matrix having the property of retaining said suspension therein after discontinuation of its passing through the matrix;

(b) after conducting step (a) for a selected treatment period, maintaining the magnetic field applied to the matrix while discontinuing the passing of the suspension through the matrix and passing a pressurized gas downwardly through the matrix to displace retaining suspension from the matrix;

(c) after step (b), discontinuing the magnetic field and flushing the matrix by passing a flush liquid therethrough in the absence of the magnetic field to flush collected particles from the matrix, the matrix also having the property of retaining said flush liquid therein after discontinuation of its passing through the matrix, and thereafter passing a pressurized gas downwardly through the matrix to displace retained flush liquid therefrom;

(d) recovering the displaced suspension of step (b); and (e) repeating the above steps for a plurality of cycles.

2. The method of claim 1 wherein the matrix comprises a body of filamentary, ferromagnetic metal.

3. The method of claim 1 wherein the suspension is an aqueous suspension of clay particles.

4. The method of claim 3 wherein the clay particles comprise kaolin clay particles and the impruities comprise colorant impurities naturally occurring in the clay.

5. The method of claim 1 wherein the flush liquid is water.

6. The method of claim 1 wherein the pressurized gas is air.

7. The method of claim 1 wherein the flush liquid is water and the pressurized gas is air.

8. The method of claim 1 wherein the pressurized gas comprises air at a pressure of from about 8 to 18 psig.

9. The method of claim 8 wherein the pressurized air is at a pressure of from about 10 to 15 psig.

10. The method of claim 8 wherein the pressurized air is at a pressure of about 13 psig.

11. The method of claim 1 wherein the intensity of the magnetic field applied to the matrix is from about 5 to 30 kilogauss.

12. The method of claim 11 wherein the intensity of the magnetic field is from about 8.5 to 20 kilogauss.

13. The method of claim 11 wherein the intensity of the magnetic field is about 16 kilogauss.

* * * * *

UNITED STATES PATENT AND TRADEMARK OFFICE

CERTIFICATE OF CORRECTION

PATENT NO. : 4,784,758

DATED : 11/15/88

INVENTOR(S) : Willis, Mitchell J.

It is certified that error appears in the above—identified patent and that said Letters Patent is hereby corrected as shown below:

| | | | |
|---|---|---|---|
| Col. 16 | Line 13 | Change To: | "account" |
| | | From: | "aooount" |
| Col. 20 | Line 34 | Change To: | "attractable" |
| | | From: | "attractagle" |

Signed and Sealed this

Fourth Day of December, 1990

*Attest:*

HARRY F. MANBECK, JR.

*Attesting Officer*

*Commissioner of Patents and Trademarks*